United States Patent [19]

Hentschel

[11] 3,973,984

[45] Aug. 10, 1976

[54] CONTINUOUSLY OPERABLE SUGAR CENTRIFUGE

[75] Inventor: Volkmar Hentschel, Braunschweig, Germany

[73] Assignee: Braunschweigische Maschinenbauanstalt, Braunschweig, Germany

[22] Filed: Oct. 23, 1975

[21] Appl. No.: 624,738

[30] Foreign Application Priority Data

Nov. 26, 1974 Germany ..... 2455812

[52] U.S. Cl. ..... 127/19; 127/56; 210/369; 210/378; 233/2; 233/3; 233/26; 233/46

[51] Int. Cl.[2] ..... C13F 1/06; C13F 1/10

[58] Field of Search ..... 127/19, 56; 210/369, 210/378

[56] References Cited

UNITED STATES PATENTS

| | | | |
|---|---|---|---|
| 2,883,054 | 4/1959 | Sanchez | 127/19 X |
| 3,650,465 | 3/1972 | Grimwood | 127/19 |
| 3,805,956 | 4/1974 | Mercier | 127/19 |

*Primary Examiner*—Morris O. Wolk
*Assistant Examiner*—Sidney Marantz
*Attorney, Agent, or Firm*—W. G. Fasse; W. W. Roberts

[57] ABSTRACT

Continuously operable sugar centrifuge comprises a number of centrifuging channels forming part of a conical frustum and being symmetrically distributed relative to a rotational axis. Preferably, two channels are arranged to receive the massecuite through massecuite supply conduits connected to the upper ends of the centrifuging channels. The lower ends of the centrifuging channels are connected through radially extending sugar discharge conduits leading to a sugar outlet arranged coaxially with the drive shaft of the centrifuge. The sugar conduits have a radial dimension so that their outer ends extend outside of the centrifuging channels. The outer ends of the sugar conduits are provided with funnels facing with their open face in the direction of rotation of the centrifuge whereby an air stream transports the sugar radially inwardly from the centrifuging channels to the sugar outlet.

14 Claims, 4 Drawing Figures

CONTINUOUSLY OPERABLE SUGAR CENTRIFUGE

BACKGROUND OF THE INVENTION:

The present invention relates to a continuously operable sugar centrifuge wherein centrifuging channels including outwardly facing screen walls are arranged on the circumferential surface of a conical frustum rotatable about a central rotational axis. Passage means lead into the channels for supplying wash and/or coating mediums to the massecuite which reaches the screen surface.

Different kinds of continuously operable or operating sugar centrifuges are well known in the art. Known centrifuges of this type generally operate in accordance with the so called thin layer principle, whereby the massecuite is distributed in thin layers onto a centrifuging screen drum. The screen drums have a conical frustum shape and the screen proper is secured to the inside of the frustum. The operational conditions of known centrifuges of this type are adjustable. One adjustment may be made with regard to the rotational speed of the centrifuge. Another adjustment may be made with regard to the angle of inclination of the screen surface relative to the rotational axis of the centrifuge. Thus, the operational conditions may be adjusted in such a manner that the massecuite which is supplied to the screen drum at the smaller diameter end of the drum forms a uniform thin layer over the entire screen surface. Such thin layer travels with a predetermined speed along the screen surface toward the discharge end located at the larger diameter end of the centrifuge jacket. During this travelling of the massecuite along the screen the liquid present in the massecuite is first centrifuged out of the massecuite. The wash or coating liquid, which is later supplied to the crystal layer, is centrifuged in the same manner to clear or free the crystals from any liquid remainders of the massecuite still sticking to the crystals.

Past experience has shown that so far it has not been possible to use these continuously operating or operable centrifuges for producing satisfactorily white sugar from so called A-type massecuite. This type of massecuite yields white sugar which does not require any further treatment in its production.

One reason for these difficulties is seen in that, according to experience, thin layers of sugar crystals do not yield a satisfactory washing. Another difficulty is seen in that the removal of the sugar crystals from the continuously operating centrifuge results in a substantial proportion of crystal breakage. So far it has not been possible to avoid such crystal breakage in spite of many efforts to solve this problem.

On the other hand, it is not possible to use thicker sugar crystal layers in continuously operating centrifuges of the known type because thicker layers tend to shift on top of each other in the conical drum during the centrifuging. Such shifting of the crystal layers reduces the quality of the centrifuging result whereby the efficiency as well as the sugar quality is reduced. Yet another drawback is seen in that the thicker layers may cause unbalances of the rotating drum which places undesirably heavy loads on the drum bearings thereby creating well known disadvantages and dangers.

OBJECTS OF THE INVENTION

In view of the above, it is the aim of the invention to achieve the following objects singly or in combination:

to avoid the drawbacks of the prior art, more specifically, to construct a continuously operable centrifuge of the mentioned type in such a manner, that the centrifuging of a thicker massecuite layer becomes possible;

to construct the sugar discharge elements in such a manner that a crystal destruction can be substantially avoided so that the centrifuge may also be used for handling so called A-type massecuite;

to construct a continuously operable sugar centrifuge in such a manner that the same results may be achieved as have been achieved heretofore with batch type centrifuges;

to guide the sugar resulting from the centrifuging radially inwardly toward the rotational axis of the centrifuge so that the sugar crystals may freely fall downwardly;

to assure a uniform thickness of the massecuite layer over the entire screen surface to thereby subject the massecuite to a uniform treatment over the entire centrifuging process;

to facilitate the supply of wash and/or coating mediums;

to construct at least one wall of the centrifuging channels in such a manner that it may adapt its position to massecuite layers of varying thickness to thereby assure that the respective channel is always completely filled, thereby avoiding the shifting of one crystal layer on top of another crystal layer;

to control the movement sequence of the massecuite and/or of the sugar crystals through the centrifuging channels by giving these channels differing shapes; and to transport the sugar crystals radially inwardly by means of an air flow toward an axially located sugar outlet.

SUMMARY OF THE INVENTION

According to the invention there is provided a continuously operable sugar centrifuge in which a number of centrifuging channels are arranged on the circumferential surface of a conical frustum in a symmetrical manner relative to the rotational axis of the centrifuge. Preferably, two such channels are provided on opposite sides of the circumferential surface relative to the rotational axis. These channels are relatively narrow compared to the circumferential surface of the conical frustum. Screens facing outwardly constitute the outer wall of these channels for the passage of the massecuite. The latter is supplied into these channels by massecuite conduits extending radially outwardly from a hopper type inlet arranged around the rotational axis and into one end of the respective centrifuging channel. Sugar discharge conduits are arranged at the opposite end of the centrifuging channel. The sugar discharge conduits extend radially inwardly to a sugar outlet and have a radial dimension to reach radially outwardly of the respective centrifuging channel so that a funnel type air intake facing into the rotational direction of the centrifuge produces an air flow for transporting the sugar radially inwardly toward and through the sugar outlet which faces axially in the direction of the rotational axis of the centrifuge.

As compared to prior art continuously operating centrifuges, the centrifuge according to the invention does not comprise a conical frustum drum carrying the screen inside thereof. According to the invention, centrifuging channels are provided for the passage of the massecuite and these channels are connected, for example, through arms with the rotational axis of the centrifuge. The outer surfaces of these channels are formed by screen walls which extend at an angle relative to the rotational axis of the centrifuge and these screen walls are rotated about the rotational axis along the surface of a conical jacket. The massecuite is supplied into the just described channels through conduits connecting an inlet hopper with one end of the respective channel. The inlet hopper is arranged around the rotational axis. The massecuite in the massecuite conduits generates a pressure as the result of the centrifugal force and this pressure pushes the massecuite sufficiently to travel through the centrifuging channels. The massecuite layers in these centrifuging channels have a thickness corresponding to the cross section of the channels. In other words, the entire channel is filled with massecuite and the danger of massecuite layers shifting one on top of the other has been eliminated. Moreover, another advantage is seen in that the efficiency of the washing depends on the thickness of the massecuite layer. As a result, according to the invention, it is now possible to wash the sugar crystal layer in the present centrifuge practically with the same results as have been heretofore achieved in batch type centrifuges.

The discharge of the sugar crystals, according to the invention, takes place in the direction toward the rotational axis of the centrifuge and into a discharge outlet. Thus, the discharge employed heretofore wherein the sugar must travel over the circumferential rim of the drum outwardly has been avoided. It is believed that this feature of the invention substantially contributes to maintaining the sugar crystal undisturbed. This is further enhanced by transporting the sugar through the discharge conduits by a pneumatic feed advance which uses an air flow. The air flow is produced by means of an air intake facing into the direction of rotation of the centrifuge and connected to the radially outer ends of the sugar conduits. The sugar conduits in turn face radially inwardly. By properly dimensioning the air intake funnel and the air conduit it is possible to effectively control the sugar discharge toward the rotational axis of the centrifuge where the sugar crystals may freely fall downwardly in the direction of said rotational axis.

BRIEF FIGURE DESCRIPTION

In order that the invention may be example, understood, it will now be described, by way of examaple, with reference to the accompanying drawings, wherein.

Figure 1:
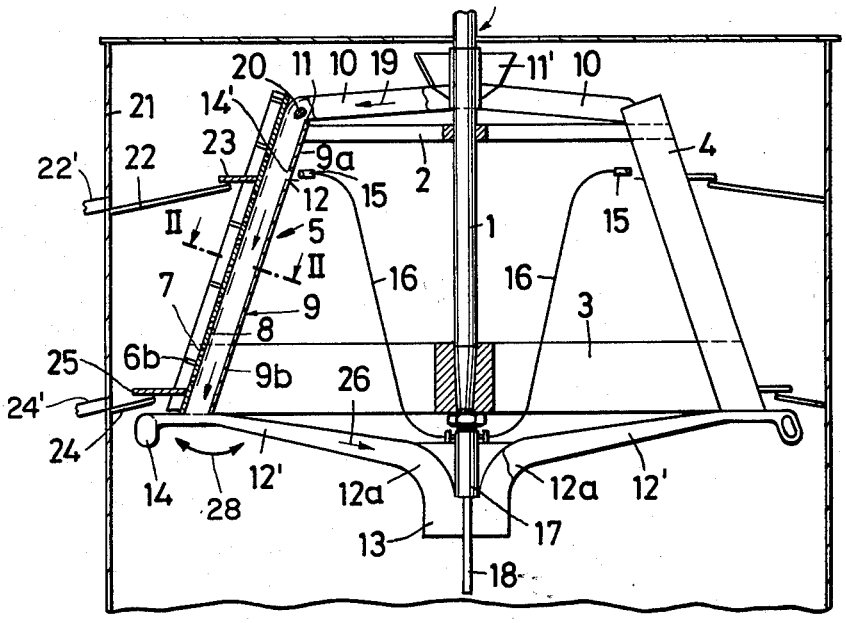
FIG. 1 is a somewhat simplified sectional view through a centrifuge according to the invention whereby the section extends through the rotational axis of the centrifuge.

DETAILED DESCRIPTION OF EXAMPLE EMBODIMENTS:

The centrifuge shown in FIG. 1 has a rotational shaft 1 and a housing 21. The rotational shaft is supported in the housing or in a frame structure in conventional bearings, not shown. A motor, not shown, drives the shaft in the direction of the arrow 27, shown in FIG. 2. Supporting arms 2 and 3 rigidly secured to the drive shaft 1 carry two centrifuging channels 4 and 5. The channels 4 and 5 are arranged symmetrically relative to the shaft 1 whereby the right hand channel 4 is shown schematically whereas the left hand channel 5 is shown in section. Each of the channels 4 and 5 comprises a casing 6 with side walls **6*a*, a rear wall 9 and a screen wall 6*b* with passages 7 in the screen wall. The screen wall 6*b* supports screen means 8. The arrangement and details of the inwardly facing wall 9 of each casing 6** will be described in more detail below.

Figure 2:
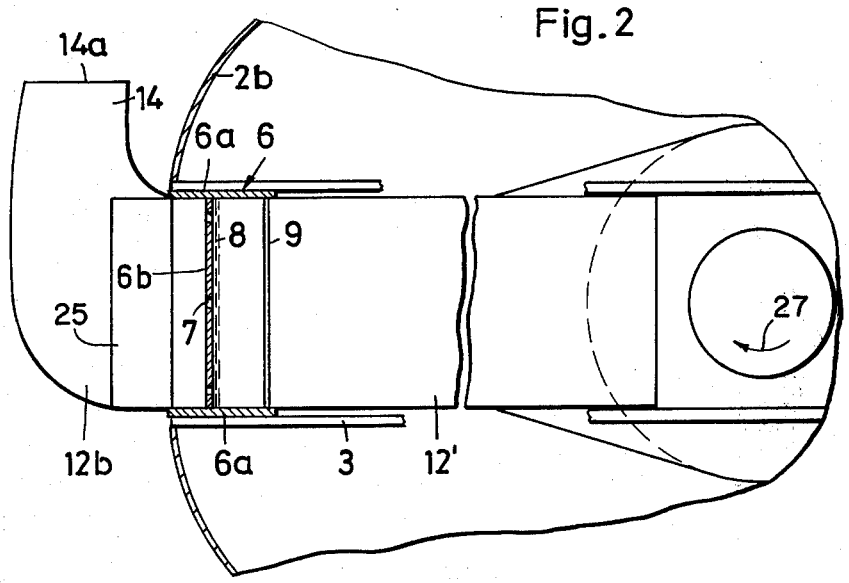
FIG. 2 is a sectional view on an enlarged scale along the section line II—II in FIG. 1.

FIG. 2 illustrates that the channels 4 and 5 define a passage way having a substantially rectangular cross sectional acrea. The upper end of these channels 4, 5 is connected through a respective massecuite supply conduit 10 to a massecuite inlet hopper 11′ which surrounds the drive shaft 1, as best seen in FIG. 1. Thus, the massecuite is supplied by the centrifugal force 19 into the channels 4 and 5 at the upper end thereof. The opposite end of these channels, that is the lower end as seen in FIG. 1, is connected to sugar discharge conduits 12′ which merge through an elbow **12*a* into a sugar outlet port 13 which in turn surrounds the drive shaft 1. In the illustrated embodiment the two elbows 12*a* connect into the outlet port 13. However, the outlet port may accommodate more than two sugar discharge conduits 12′**, for example, four spaced from each other at 90°.

The sugar emerging from the lower end of the channels 4 and 5 is transported through the sugar discharge conduits 12′ in the direction of the arrow 26 by means of an air flow created by an air intake funnel 14 having an open end **14*a* facing in the direction of rotation as best seen in FIG. 2. The discharge conduits 12′ extend radially outwardly to connect into the respective funnel 14 and the inlet area 14*a* as well as the cross sectional area through the funnels is dimensioned in such a manner that the air stream will be sufficient for transporting the sugar radially inwardly toward the sugar outlet port 13. To this end, the air intake 14 merges through a bend or elbow 12*b* into the radially outward end of the sugar conduit 12′. Furthermore, it is advantageous to increase the cross sectional area of the sugar discharge conduits in the bend or elbow 12*a* in order to reduce the air flow speed in this area so that the sugar may freely fall downwardly through the port 13** without damage to any of the sugar crystals.

The rear wall 9 of the channels 4 and 5 comprises two wall sections **9*a* and 9*b* which are spaced from each other to provide a slot type passage 14′ for admitting a washing liquid and/or a coating medium into the channels 4, 5. According to the invention, there are provided hinges 11 and 12 which hinge the respective wall sections 9*a* and 9*b* to the frame structure of the centrifuge. Since the wall sections 9*a* and 9*b* are hinged at their upper ends they are free to swing in the direction of the arrow 28. Further, due to the centrifugal force, which is effective when the centrifuge rotates, the wall sections 9*a* and 9*b* will tend to swing toward the screen wall 6*b*. This feature of the invention assures that the rear wall will always contact the massecuite in the respective channels 4, 5 even if the thickness of the layer of the massecuite travelling along the screen surfaces 8 should vary. As a result, the cross sectional passage area of the channels 4, 5 will always be completely filled whereby any shifting of one layer on top of the other is definitely avoided. Moreover, the rectangular shape of the passage channels 4, 5** is maintained so that a uniform thickness of the massecuite over the entire screen surface is also assured whereby the invention achieves a uniform treatment of the massecuite during the entire centrifuging.

Incidentally, the wash or coating medium may be supplied into the channels 4, 5 through the above described slots 14' which extend in the circumferential direction of the respective channels 4, 5. To this end, there are arranged nozzles 15 opposite the slots 14' and the nozzles in turn are connected by a pipe or hose 16 to a supply pipe 18 through a rotary valve mechanism 17. The wash or coating medium may, for example, be water. Instead of using two separate wall sections 9*a*, 9*b* as illustrated in FIG. 1, it is also possible to provide the rear wall 9 with a plurality of holes, slots or the like for the coating or wash medium. In any event, the spray nozzles 15 would be arranged to rotate with the centrifuge and the wash or coating medium would pass through the rear wall 9 onto the massecuite.

In the operation of the centrifuge according to FIGS. 1 and 2, the massecuite is supplied into the hopper 11' and due to the centrifugal force it travels through the supply conduits 10 in the direction of the arrow 19. The radially outward ends of the conduits 10 reach into the upper ends of the centrifuging channels 4, 5 whereby it is advantageous to insert a massecuite divider 20 into the passage where the conduits 10 merge into the channels 4, 5. These dividers 20 somewhat increase the pressure in the massacuite so that the pressure at the upper entrance end of the channels 4, 5 is somewhat larger than about halfway down in the respective channel 4, 5. Thus, the divider 20 facilitates a uniform distribution of the massecuite over the entire sectional area of the centrifuging channels 4, 5. The massecuite is separated in the upper portion of the channels 4, 5 into syrup and sugar crystals whereby the syrup escapes through the openings 7 in the upper section of the wall 6*b*. A centrifuging wall 23 is secured to the centrifuge outer wall 6*b* approximately opposite the gap 14'. A syrup guide surface 22 extends from an outlet 22' in the housing 21 to an area directly below the centrifuging wall 23. The guide wall 22 is outwardly and downwardly inclined to facilitate the outflow of the syrup.

Due to the hinging of the upper section of the rear wall 9*a* by the hinge 11, it is assured that the centrifugal force will also press the wall section 9*a* against the massecuite in the upper portion of the channel 4, 5 even if the volume of the supplied massecuite should be reduced. This feature of the invention has the advantage that a shifting or sliding of one massecuite layer on top of the other is avoided.

Directly below the wall section 9*a* and about at the level of the centrifuging wall 23 water is sprayed onto the massecuite which has been substantially freed of the syrup. In other words, the water is sprayed onto the sugar crystals which are still coated with the remainder syrup. The spray water is supplied through the nozzles 15 and the gap 14' as described. The wash or spraying liquid is removed by centrifuging through the apertures in the wall 6*b* below the centrifuging wall 23. A further centrifuging wall 25 is secured to the lower end of the channels 4, 5 and the centrifuging wall 25 delivers the centrifuged wash liquid onto a buffle plate 24 which permits a flow off of the wash liquid to an outlet 24'. The buffle plate or separation wall 24 extends also to a point below the centrifuging wall 25.

The sugar crystals downwardly through the channels 4, 5 and enter into the sugar discharge conduits 12' where an air stream generated by the air intake 14 blows the sugar in the direction of the arrow 26 toward the sugar outlet 13. The pipe elbow 12*a* of increasing cross sectional area merges the sugar discharge conduits 12' into the common outlet 13. The increase in cross sectional area has the advantage that the feed advance speed of the sugar is reduced and that it thus may freely fall downwardly through the outlet 13 after passing through elbows 12*a*.

Figure 3:
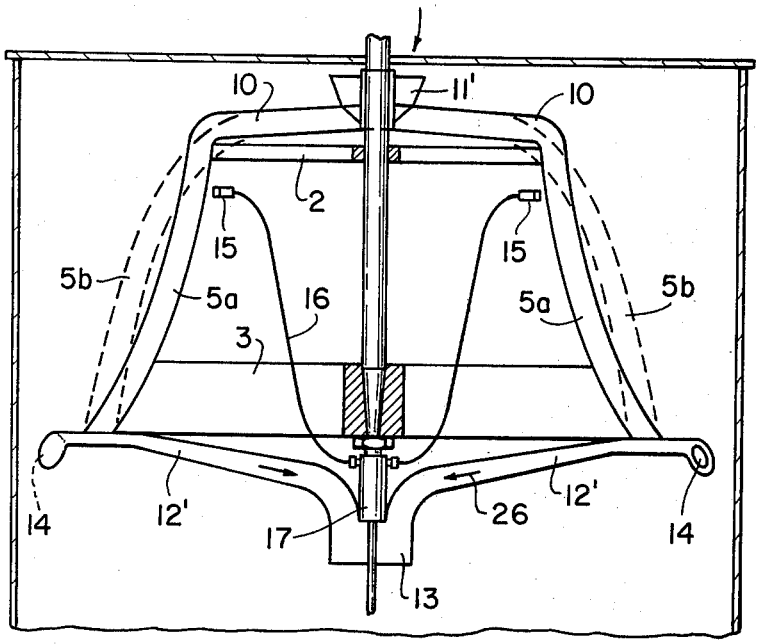
FIG. 3 is a view similar to that of FIG. 1 but illustrating a curved shape for the centrifuging channel.
Figure 4:
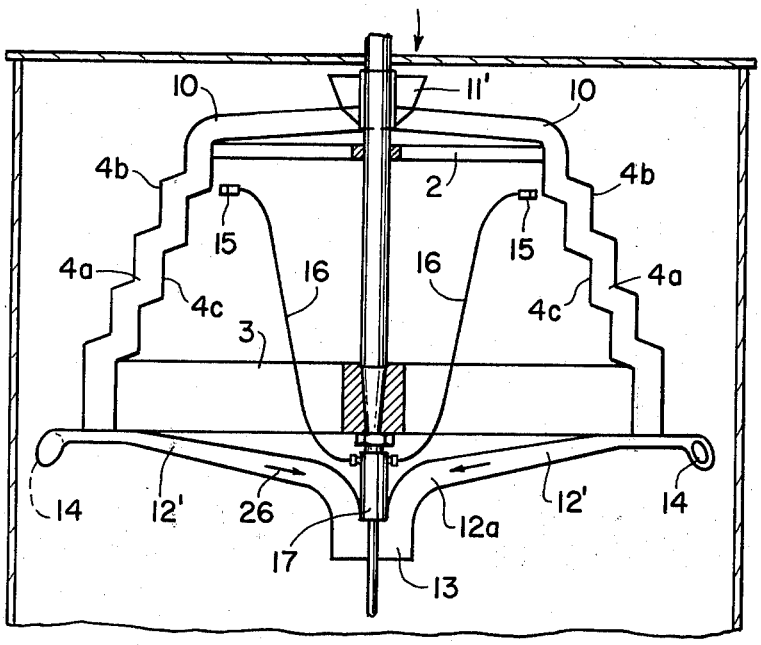
FIG. 4 is a view similar to that of FIG. 1 but illustrating a stepped shape for the centrifuging channel.

FIGS. 3 and 4 illustrate that the centrifuging channels do not have to be straight but may have a bend and/or stepped configuration in order to differently influence the movement or flow sequence of the massecuite or of the sugar crystals. The screen surfaces thus may be concave or convex relative to the rotational axis of the centrifuge. The centrifuging channels in stepped form, as shown in FIG. 4, provide an additional circulating effect for the massecuite or for the sugar crystals depending on the location of the steps along the channel. As shown, the steps extend along the entire length of the channel, but the steps may be provided only at the top end, or only at the bottom end or at any location along the length of the channel.

The details of FIG. 1 are not shown in FIGS. 3 and 4, however, the same reference numerals have been employed as in FIGS. 1 and 2 except that the curved channel 5*a* has a convex form as viewed from the rotational axis 1 whereas the curved channel 5*b*, shown in dash dotted lines and illustrating a modification, has a concave configuration as viewed from the rotational axis 1. It should also be noted that the inner wall of these curved channels 5*a*, 5*b* is permeable to the liquid sprayed onto these inner surfaces through the nozzle 15. For example, these inner walls of the channels 5*a*, 5*b* could be perforated, or screen walls could form these curved channel rear walls.

Although not shown in FIGS. 3 and 4, the rear walls could also be hinged to the supporting structure 2, 3 as described with reference to FIG. 1. One hinge or several hinges could be employed if it is desired to separate the rear walls into several sections also as described above with reference to FIG. 1.

FIG. 4 illustrates a stepped channel 4*a* whereby the individual steps are interconnected at 4*b*. The respectively stepped rear wall 4*c* may also be hinged and/or separated into several sections. In any event, the rear wall 4*c* will be provided with slots, apertures or the like for the passage of the wash liquid from the nozzles 15.

It is possible, according to the invention, to combine in one and the same centrifuge channels of different configurations. Thus, two channels could have the configuration shown in FIG. 3 whereas two other channels could have the configuration shown in FIG. 4.

By properly dimensioning the steps and the transition zones between adjacent steps, it is possible to provide for a circulation or rotation of the massecuite in the channels. Further, these steps also permit controlling the residence time of the massecuite in the channels. This control is also possible by the bent configuration of the channels of FIG. 3.

As mentioned above, instead larger using two channels it is possible to employ a large number, for example, three or more which are symmetrically distributed about the circumference of the rotating centrifuge body. In any event, it must be assured that sufficient air is supplied for each air intake 14 to maintain a certain flow speed and to supply a certain air quantity for the pneumatic feed advance of the sugar to be discharged through the discharge conduits 12' radially inwardly to the outlet 13.

In order to reduce the air resistance when the centrifuging body rotates, it is desirable to cover the space between adjacent channels. This is shown in FIG. 2 where sheet metal walls 2*b* interconnect adjacent channel structures with their respective inlet and outlet conduits. Thus, the rotating body of the centrifuge has a conical frustum shape from which the air intakes 14 protrude facing in the direction of rotation as indicated by the arrow 27.

Although the invention has been described with reference to specific example embodiments, it will be appreciated, that it is intended to cover all modifications and equivalents within the scope of the appanded claims.

What is claimed is:

1. In a continuously operable sugar centrifuge having a housing, screen means forming a rotational surface supported for rotation about a rotational axis in said housing, a drive shaft, means connecting said screen means to said drive shaft, massecuite supply means arranged to feed massecuite to said screen means and passage means leading to said screen means, the improvement comprising channel means as part of said screen means arranged symmetrically relative to said rotational axis, conduit means operatively connecting said channel means to said massecuite supply means to feed the massecuite to one end of said channel means, outwardly facing screen walls as part of said channel means, sugar discharge means including a sugar outlet operatively connected to the other end of said channel means, and air inlet funnel means operatively connected to said sugar discharge means for facilitating the transport of the sugar to said sugar outlet.

2. The sugar centrifuge according to claim 1, wherein said screen means form a portion of a conical frustum arranged for rotation in said housing, said channel means comprising two channels arranged near the surface of said frustum at opposite sides thereof and symmetrically relative to said rotational axis, said massecuite supply means comprising an inlet hopper arranged centrally around said rotational axis, said conduit means extending substantially radially outwardly to connect said inlet hopper to one end of each of said channel means, said sugar discharge means extending substantially radially inwardly to connect the other end of said channel means to said sugar outlet located centrally relative to said rotational axis.

3. The sugar centrifuge according to claim 2, wherein said sugar discharge means have outer ends and such a radial dimension that the outer ends extend radially outwardly of said channel means, said air inlet funnel means being connected to said outer ends of the sugar discharge means and facing with their open faces in the direction of rotation of said centrifuge whereby an air stream advances the sugar toward said sugar outlet, and wherein said sugar discharge means include elbow pipe means connecting the sugar discharge means proper to said sugar outlet.

4. The sugar centrifuge according to claim 2, wherein said conical frustum faces upwardly with its smaller diameter end and downwardly with its larger diameter end, said massecuite supply means connecting said inlet hopper to said channel means at said smaller diameter end, and said sugar discharge means connecting said sugar outlet to said channel means at said larger diameter end.

5. The sugar centrifuge according to claim 1, wherein said channel means have a substantially rectangular cross-section.

6. The sugar centrifuge according to claim 1, wherein said channel means comprise inwardly facing walls, said passage means being located in said inwardly facing walls and extending in the direction of rotation of said centrifuge, said centrifuge further comprising spray means arranged for spraying a liquid through said passage means.

7. The sugar centrifuge according to claim 6, wherein said inwardly facing walls comprise two wall sections spaced from each other to form said passage means.

8. The sugar centrifuge according to claim 1, wherein said channel means are formed by said outwardly facing screen walls, by inwardly facing walls and by lateral walls, said inwardly facing walls comprising areas for passing liquid therethrough.

9. The sugar centrifuge according to claim 1, wherein said channel means have a narrow circumferential dimension relative to the circumference of said rotational surface.

10. The sugar centrifuge according to claim 1, wherein said channel means comprise inwardly facing walls opposite said outwardly facing screen walls, and side walls extending from said screen walls to said inwardly facing walls, said channel means forming a portion of a conical frustum having a larger diameter end and a smaller diameter end, and hinge means securing said inwardly facing walls of said channel means to said connecting means near the smaller diameter end of said frustum.

11. The sugar centrifuge according to claim 1, wherein said channel means comprise inwardly facing walls opposite said outwardly facing screen walls, and side walls between said screen walls and said inwardly facing walls, said channel means being curved from one end thereof to the other.

12. The sugar centrifuge according to claim 1, wherein said channel means comprise inwardly facing walls opposite said outwardly facing screen walls and side walls between said screen walls and said inwardly facing walls, said channel means having a stepped shape between one end thereof to the other end thereof.

13. The sugar centrifuge according to claim 1, wherein said sugar discharge means comprise substantially radially extending conduit means, bend conduit means merging said radially extending conduit means into said sugar outlet whereby the latter extends in the direction of the rotational axis and receives the sugar from all radially extending conduit means.

14. The sugar centrifuge according to claim 1, further comprising massecuite separator means located substantially where said massecuite supply means merge into said channel means.

* * * * *